United States Patent [19]

Lessi

[11] Patent Number: 5,042,297

[45] Date of Patent: Aug. 27, 1991

[54] WELL-LOGGING PROCESS AND DEVICE IN A NON-FLOWING PRODUCTION WELL

[75] Inventor: Jacques Lessi, Maule, France

[73] Assignee: Institut Francais du Petrole, Rueil Malmaison, France

[21] Appl. No.: 422,105

[22] Filed: Oct. 16, 1989

[30] Foreign Application Priority Data

Oct. 14, 1988 [FR] France ..... 88 13605
Mar. 29, 1989 [FR] France ..... 89 04225

[51] Int. Cl.[5] ..... E21B 49/08
[52] U.S. Cl. ..... 73/155; 166/250
[58] Field of Search ..... 73/155, 151, 195, 196, 73/716, 736, 863.41, 155; 166/250

[56] References Cited

U.S. PATENT DOCUMENTS 2,379,138 6/1945 Fitting, Jr. et al. ..... 73/155

FOREIGN PATENT DOCUMENTS

•0691723 10/1979 U.S.S.R. ..... 73/863.41
1244162 7/1986 U.S.S.R. ..... 73/155

*Primary Examiner*—Jerry W. Myracle
*Attorney, Agent, or Firm*—Antonelli, Terry, Stout & Kraus

[57] ABSTRACT

A well logging process and device for use in a non-flowing production well, wherein the well is activated to trigger production of effluents on both sides of a first measuring arrangement, with at least a part of the effluents coming from upstream of the flow, relative to the measuring arrangement and being handled by the measuring arrangement.

20 Claims, 3 Drawing Sheets

PROCESS-ING EQUIP-MENT
PUMP
110
100
25
27
25
34
33
31
32
24
26
28
35
4
29
30
9
10

46
39
38
45
41
47
40
420
42
37
44
43
36

WELL-LOGGING PROCESS AND DEVICE IN A NON-FLOWING PRODUCTION WELL

FIELD OF INVENTION

The present invention relates to a method and device for production well-logging in slanting or horizontal wells.

BACKGROUND OF THE INVENTION

It must first be emphasized that production well-logging may play an essential role in the operational strategy of working a horizontal or sharply slanting oil well, if well-logging can be performed correctly. It is generally agreed that one horizontal well may replace several vertical wells (generally two to four) both from the standpoint of the output they may furnish (increased production index) and that of recovery (increasing the drainage area and decreasing water coning problems).

Although this dual advantage of the horizontal well is valid in the case of a homogeneous reservoir, this cannot be the case in the far more frequent instance of heterogeneous reservoirs. Because of the presence of heterogeneities, the total output of the well may not be profitable because of inflowing water, which may be characterized by an overly high "water-cut ratio" (Quantity of Water divided by Quantity of Liquid) or an overly high Gas Oil Ratio (GOR). The output may be too low, for example, to confine the GOR to an acceptable value, even though this production problem may arise from a limited portion of the drain. Even if this type of problem does not lead to automatically excluding the use of horizontal wells for this type of deposit, it is clear that the horizontal well does not in this case offer the flexibility the producer may desire to optimize exploitation of the field. Moreover, it should be noted that the set of vertical wells that may replace the horizontal well would offer more opportunities, as the vertical well draining the part of the reservoir responsible for the production problem may be easily shut off without harming production from the other wells.

This problem may obviously be avoided by using selective completion in the horizontal drain, allowing either production to be modulated section by section, or the problematic section of the drain to be shut off.

The use of selective completion may be conceived as two different stages in the life of a well: either immediately after the well has been drilled, or later, at the time the need for its use arises.

In the first case, it is clear that the decision to use selective completion is a difficult one for several reasons, namely, the additional cost involved in the selective completion equipment must be justified at the outset, and then the sections to be individualized must be defined from a static description of the reservoir.

The postponed decision has the advantage of being taken once information is available. The additional investment will be applied only to the wells that require it, and only at the time it becomes necessary. In most cases, it will be made only after the payback period of the well. Moreover, it may be easier to define which sections are to be isolated if dynamic data are also available on the reservoir, particularly by using production well-logging.

On the other hand, this intervention may be made difficult, if not impossible, by the temporary completion used during the first operating phase of the well, for example by using a non-cemented perforated liner (generally called preperforated liner by the specialists).

In addition, this production method (first phase non-selective, second phase selective) may, in certain cases, reduce eventual recovery.

The first solution (selectivity from the very start of production) thus appears to be more attractive technically, but not necessarily economically. The solution of cementing and perforating a liner over the entire length of the drain, which allows for selectivity thereafter, must in certain cases be abandoned for cost reasons.

Therefore, the best solution is to accomplish the first production phase in an open hole; however, this is not always possible because of uncertainties as to the mechanical integrity of the well.

As a result, the case most frequently encountered is that of non-cemented wells.

Whatever the type of completion used for the horizontal well, when a problem of undesirable fluid production arises, it becomes important to locate the section or sections that might be responsible for this production, and to evaluate the well's potential when these sections have been shut off.

Only production well-logging can provide the necessary answers. However, its implementation comes up against difficulties relating both to the horizontal design and to the method of completion.

Of all the possible methods of selective completion (total cementing or partial cementing, formation packers) or non-selective completion (open-hole, preperforated liner), the case of the perforated liner is the one that brings together all the difficulties. This is the case that will be considered hereinbelow, as production methods with other types of completion may be arrived at by introducing the appropriate simplifications.

The problems inherent in production measurements in horizontal wells arise from a combination of difficulties of interpretation that are known from vertical wells, and difficulties inherent in horizontal wells principally due to the way in which the sondes are moved, the particular effect of gravity, and the type of completion peculiar to this type of well (large liner diameter, liner often not cemented, etc.).

SUMMARY OF THE INVENTION

The present invention concerns the case in which the well is not flowing and must be activated for production.

The present invention can also be applied to vertical wells.

The essential goal of production well-logging is to provide a flow profile for each phase along the drain. This result is obtained by carrying out and interpreting one or more measurements in the well. A "Spinner" type measurement may be used wherein a device is employed which indicates the rotational speed of a spinner driven by the flow. As a consequence, measurement depends essentially on the rate of flow of the fluid, but also on its viscosity.

The problems inherent in this type of measurement derive essentially from the heterogeneity of the velocity field in a transverse section of the well, from the stratified nature of the flow, from a possible difference in flowrates in each phase, from possible counter-current movements, for example with a counterflow behind the liner (case of noncemented completion) or, if dispersed flow can be obtained, the need to know the composition of the fluid at each phase and the viscosity of the mixture.

Tools have been designed to resolve at least some of these problems, particularly spinner-type flowmeters: FBS (full bore spinner) and turbine flowmeters with blades.

Even in the case of turbine flowmeters, there remains the problem of flow behind the liner (in the direction of the general flow, or against the flow) and the problem of calibration of the response of the helix.

With measurement by radioactive tracer there is a direct measurement of the rate of flow. The problems reported above relating to the complexity of fluid flow remain. It should be pointed out that tools using preferably oil-soluble tracers and preferably water-soluble tracers are under development.

With density measurement a measurement principle that may be used in a horizontal well is gamma-ray absorption. These measurements generally come up against a calibration problem, the problem of the representative nature of the measurement (the measurement does not cover the entire flow section), and that of the difference between the composition of the fluid in the well and that of the flowing fluid (water holdup). As far as the latter point is concerned, one feature of horizontal wells should be noted: the problem of retention of the heavy phase, in particular water, known as water holdup, is encountered whenever gravity is acting in the direction opposite the flow (vertical well with a slope of alpha less than 90°, where alpha is the angle of inclination of the well to the vertical). On the other hand, in the case where gravity is acting in the flow direction (horizontal well with alpha greater than 90°), it is probable that holdup of the light phase, such as gas, will be encountered.

With measurement of water holdup by measuring dielectric constant, the response of this type of tool requires calibration and depends very heavily on the nature of the flow (dispersion of one phase in the other).

For all these measurements, the presence of solid particles may also pose important problems, including deterioration of the flowmeter spinner.

Other types of measurement should be mentioned, such as pressure and temperature measurement.

According to the present invention, tubing is used to lower the measuring tools.

We now arrive at the concept of a modular system for measuring production in horizontal wells, the composition of which is to be defined as a function of the well, its completion, and the nature of the fluids produced. Although implementation of such a system is more cumbersome and more complex at the outset than classical production well-logging, it should be noted that, on the one hand, such classical well-logging cannot offer sufficient accuracy and that, on the other hand, these measurements will be used only when selective intervention (selective completion or selective treatment) becomes necessary and will in any event mean that the equipment will have to be removed from the well.

Implementation of production well-logging with the aid of tubing assumes, to simplify interpretation, that the distribution of pressures in the drain is not too greatly modified by the position of the tubing string in the drain, i.e. that pressure losses in the gap between the tubing and the perforated liner are negligible. This point may be verified during measurement for use of one or more pressure sensors evaluating the pressure loss in the gap.

According to the present invention, the well is activated to perform measurements. When this is done, the tubing may be fitted with a pump allowing activation of the well. For reasons of simplification of implementation, the method by which the pump is driven will then be either electric or hydraulic (turbine pump or jet pump).

Thus, the present invention relates to a process for producing production well logs in a non-flowing well that may or may not have a slanting or horizontal section; according to this process, the well is activated to start production, effluents are produced on both sides of a device that provides a seal for the annular gap between the tubing and the perforated liner, and at least part of the effluents coming from the upstream flow relative to the sealing device are treated by first pressure means.

At least part of the flow coming from downstream of the sealing device could be treated by second pressure means.

The first measuring means can treat essentially all the upstream flow.

The second measuring means can treat essentially all the downstream flow.

The pressure differential in the production well gap between the two sides of the sealing device can be monitored.

Also, balances can be calculated between the flowrates of one or more phases or species.

The first measuring means can be calibrated by eliminating downstream flow.

The present invention also relates to a device for making production well logs in a non-flowing well; this device has activation means to activate production of the well, a device for sealing the annular gap, and first measuring means, said means being located upstream of said sealing device and being designed to treat at least part of the upstream flow.

This device may have an opening between the activation means and the sealing device.

The device may have second measuring means which may treat at least part of the downstream flow, with the inlet to said second measuring means being connected to the opening.

The device may also have means for separating the upstream flow from the downstream flow relative to said sealing device.

The device may have means for measuring the pressures or pressure differentials on either side of said sealing device.

The device may have means for adjusting the pressure differential prevailing in the annular gap of the well on either side of the sealing device.

The pressure measuring means may measure this pressure differential and at least one of the upstream or downstream pressures prevailing in the annular gap in the well on either side of the sealing device.

The activation means may comprise an electric motor or a hydraulic motor.

The activation means and the measuring means may be attached to the end of a tubing.

The activation means may comprise a hydraulic motor fed by a secondary tubing located in said tubing.

The device and process according to the present invention apply to vertical, slanting, or horizontal wells.

Information may be transmitted from the well bottom by electromagnetic waves, by mud wave, or by electric cable.

The device according to the invention may comprise means for transmitting information by electromagnetic waves.

DESCRIPTION OF THE DRAWINGS

The present invention will be better understood and its advantages will emerge more clearly from the description which follows of specific and non-limiting examples illustrated by the attached drawings wherein.

In the examples given hereinbelow, the sealing means are in essentially the same location as the first measuring means.

Figure 1:
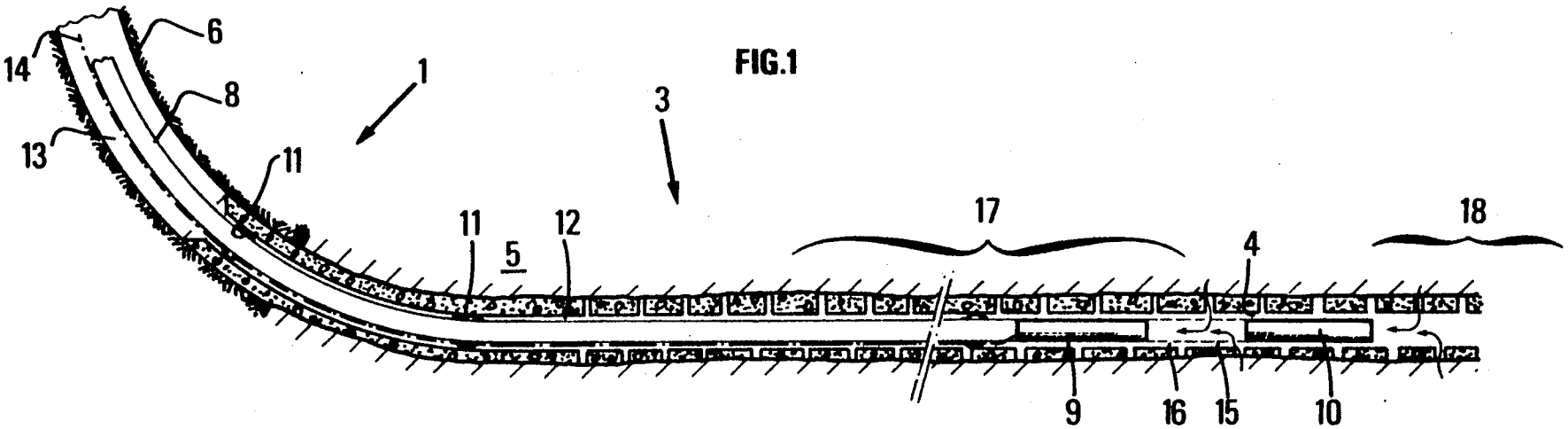
FIGS. 1 and 2 represent embodiments comprising an electric activation pump.

FIG. 1 shows a first production well 1 in which it is desired to measure the fluid flow characteristics linked to the formation along the part of the well in production, with the measurements being intended to show the variation in certain characteristics between different points of the production section of well 1. This well has a substantially vertical part not shown and a part 3 which is substantially horizontal or slanting with respect to the vertical, in which oil production is effected during normal operation.

This production section has a liner 4 perforated over at least part of its length. It is through the perforations that the fluid from geological formation 5 flows during activation.

The goal of the present invention is to obtain information on these flows in a differentiated manner in several sections of the production part of the well.

Such information may be the flow or the composition of the mixture produced. The present invention may in particular allow the flow to be detected as a function of the curved abscissa along the production drain. Thus, for example, it is possible to determine the portions of the drain for which essentially water is produced, and to act on these portions.

Reference numeral 6 designates the casing of the well in the non-producing zone and reference numeral 7, the shoe at the end of the casing.

According to the present invention, tubing 8 having a means for activating production that comprises a pump 9 and measuring equipment 10, is lowered into the well.

With this solution it is advisable to use protectors or centering devices 11 in the slanting and horizontal parts of the well.

Reference numeral 12 designates the annular part between liner 4 and tubing 8. It is in this zone that protectors 11 are located.

Figure 2:
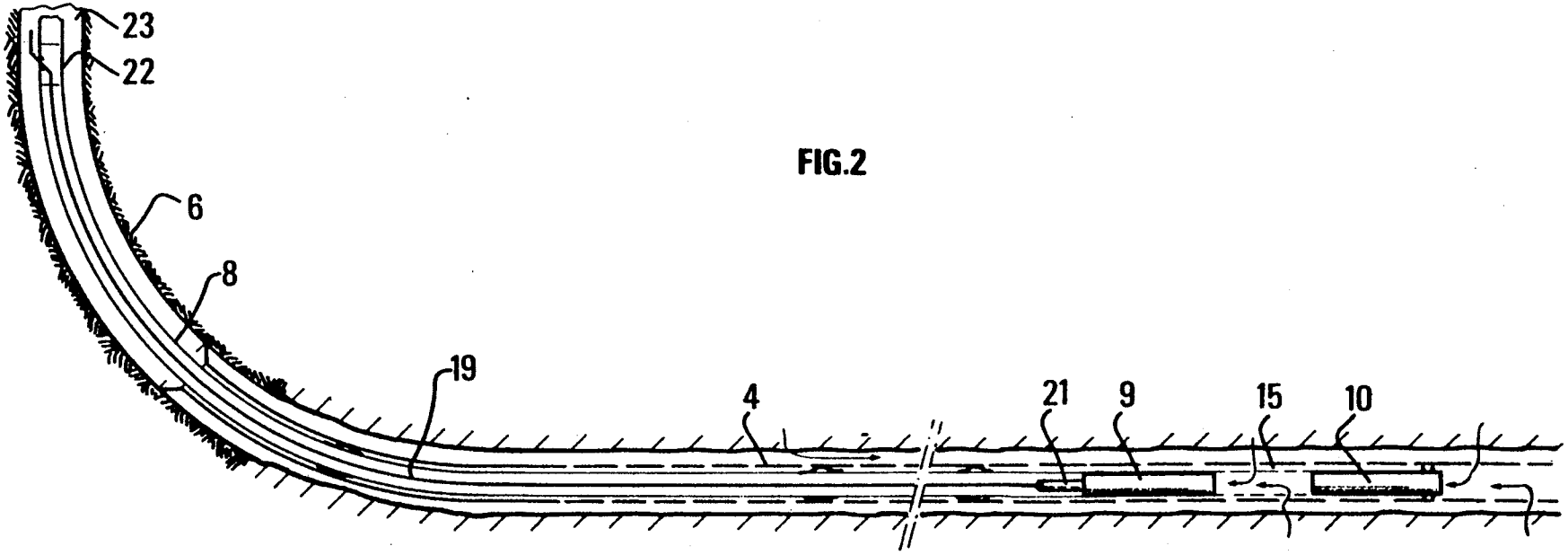

Liner 4 may be cemented (as shown in FIG. 1) or non-cemented (see FIG. 2).

In the case of FIG. 1, pump 9 is activated by an electric motor which is built into it. This motor is fed by an electric cable 14 located in annular zone 12, as well as in annular zone 13 located between the tubing and casing 6 throughout the length of the tubing. This arrangement allows the electrical connection to be made between the motor and cable at the surface. Electrical cable 14 is paid out at the surface as the elements of which tubing 8 is composed are assembled. This assembly is accompanied by increasing penetration of the motor-pump assembly into the well.

Tubing 8 is sealed along its length relative to annular gap 12. The fluid which penetrates this tubing is the fluid that has been handled by pump 9.

The intermediate zone 15 of the tubing located between pump 9 and measuring equipment 10 has openings 16.

Measuring equipment 10 is traversed by the flow of fluids coming from upstream of the well in the direction of the fluid flow from upstream part 18 and flowing toward the inlet of pump 9.

Thus, measuring equipment 10 may contain a flow channel.

According to this embodiment, when it is desired to make measurements such as flow measurements, pump 9 is activated by supplying it with electricity through cable 14.

This being the case, the well is activated and the pump drives the fluid from downstream part 17 and upstream part 18, viewed in the flow direction relative to measuring means 10.

The fluid from downstream part 17 arrives at the pump by openings 16 and the fluid from upstream part 18 passes through measuring equipment 10. Because of the existence of openings 16, measuring equipment 10 essentially handles only the fraction of effluent from the upstream part of the production drain. Thus, a selective measurement is obtained. One need then only move the pump plus measuring equipment assembly by adding or removing a number of tubing elements to arrive at a new measuring location and then conduct measurements.

Establishment of the flow balance, in particular, gives information on the pattern of certain characteristics along the production drain. Thus, it is possible to determine, as a function of the curved abscissa of the drain, the local flow from the formation and its water, gas, oil, etc. composition.

In FIG. 2, the motor plus pump assembly is supplied with energy by a cable 19 which passes inside tubing 20 and is connected to the motor by a downhole connector 21.

Reference numeral 22 designates a side-entry connector allowing passage of cable 19 into annular gap 23 of the well. This solution allows the length of cable in the annular gap of the slanting or horizontal section of the well to be reduced and, in certain cases, eliminated altogether.

Placement of cable 19 and its connection to the downhole connector are accomplished in classical fashion.

In the case of electrical pumping, transmission of, for example digital, data obtained by the measuring equipment using the power conductor or conductors located in cables 9 or 19 may be envisaged.

Figure 3:
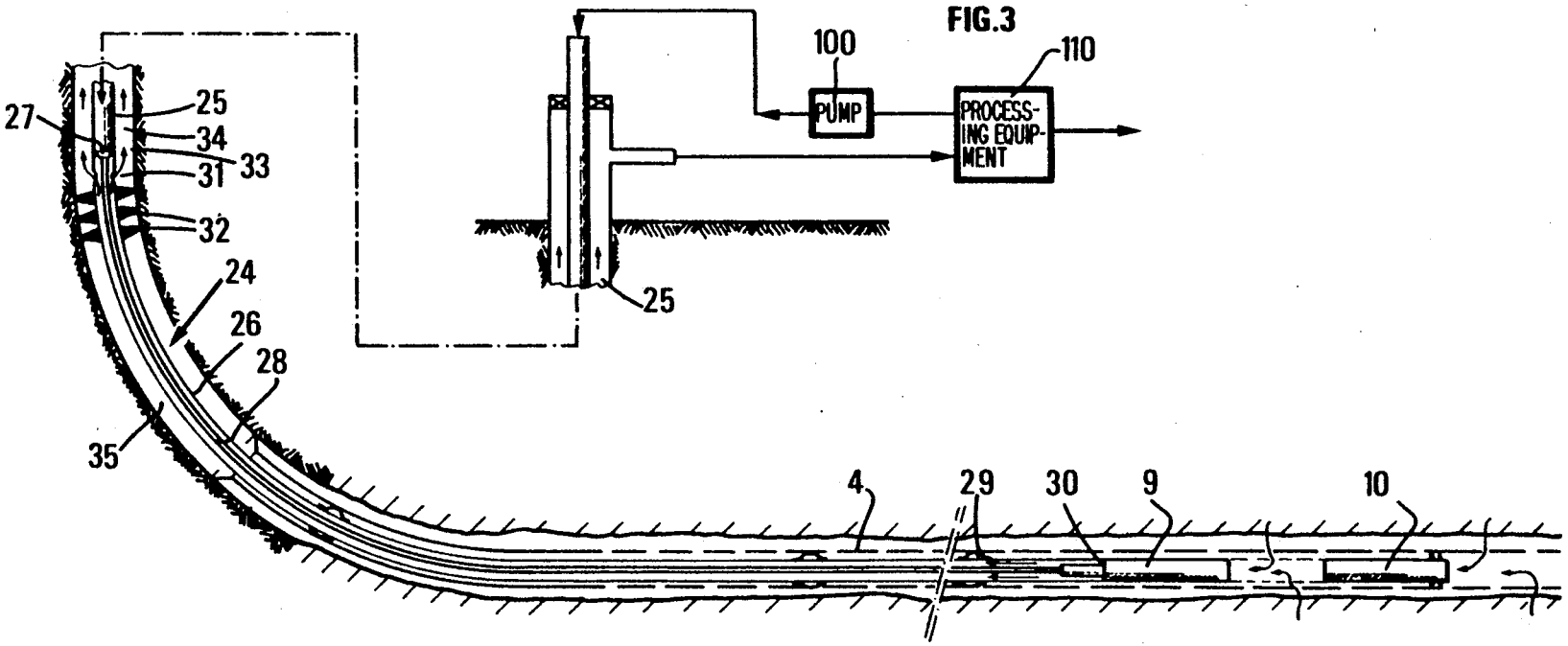
FIG. 3 illustrates an embodiment comprising a hydraulic activation pump.

FIG. 3 represents an embodiment according to which the activation pump is driven by a hydraulic fluid motor such as a lobed hydraulic motor of the "Moineau" type.

According to this embodiment, tubing 24 is lowered into the well. This tubing has two parts. First part 25 of the tubing is separated from the second part 26 of the tubing by a sealing element 27 such as a flange.

Secondary tubing 28, possibly flexible and of the coiled tubing type, connects the first part of tubing 25 to the hydraulic motor of pump 9 through the second part 26 of the tubing.

Annular gap 29 between the second part 26 of the tubing and the secondary tubing communicates with discharge ports 30 of pump 9. Moreover, this annular gap 29 communicates with annular gap 34 between first part 25 of the tubing and the casing via openings 31 provided in the vicinity of the upper end of second part 26 of the tubing above sealing element 27.

Reference numeral 32 designates sealing means such as cup washers. These washers provide a seal between casing 33 and tubing 24.

Thus, the annular gap between casing 33 and tubing 24 is divided in half.

Washers 32 are located below openings 31. Thus, upper annular gap 34 located between tubing 24 and casing 33 communicates through openings 31 with annular gap 29 provided between secondary tubing 28 and the inner wall of the second part 26 of tubing 24.

Lower annular gap 35 is delimited by casing 33, washers 32, and the outer wall of second part 26 of tubing 24.

The part located under pump 9, i.e. the intermediate zone and the measuring equipment, is essentially identical to that of FIGS. 1 and 2; moreover, the common elements have the same reference numbers.

In this embodiment, the drive fluid which supplies the hydraulic motor is transferred from surface pumps 100 through the first part 25 of tubing 24, through the secondary tubing into the hydraulic motor which drives pump 9 and is then driven at the same time as the fluid pumped out of the drain, through discharge ports 30 to annular gap 29; it passes through openings 31 to reach upper annular gap 34 and then reach the surface where it can be handled by processing or treating equipment 110. Of course, sealed washers 32 prevent it from reaching lower annular gap 35.

In this type of pumping, the measurements made at the bottom of the well can be transmitted to the surface by pressure pulses in the drive fluid circuit of the pump (mud wave or MWD type transmission).

The reliability of the production measurements and calibration of the sensors may be increased by simultaneously conducting identical measurements on the upstream part of the flow and on the downstream flow of the production drain, looking in the flow direction.

Figure 4:
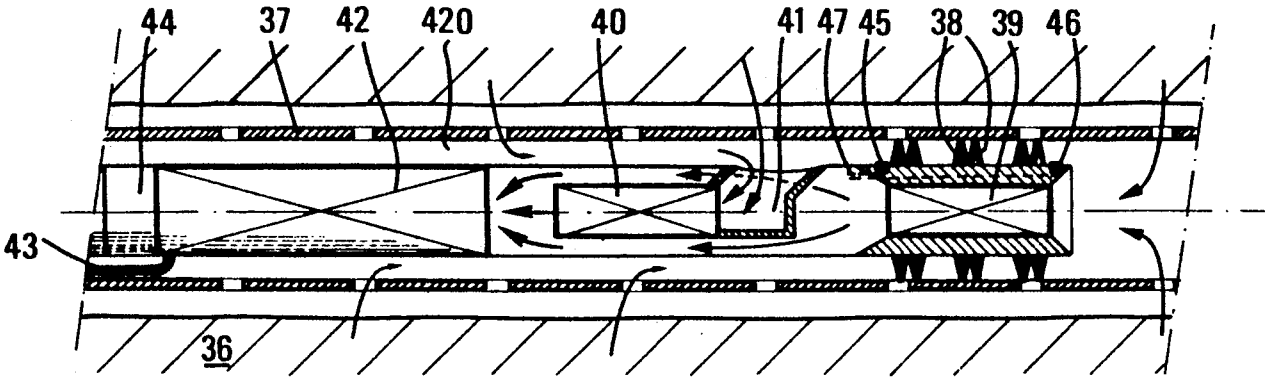
FIG. 4 shows the arrangement of the measuring assemblies relative to the fluid flow diagram.

In FIG. 4, reference numeral 36 designates the geological formation, reference numeral 37 designates the perforated liner, and reference numeral 38, the cup washers. Of course, these washers 38 allow the upstream part of the flow to be isolated from the downstream part.

Reference numeral 39 designates the measuring equipment operating with the upstream flow; functionally, these means correspond substantially to those shown in FIGS. 1, 2, and 3.

Reference numeral 40 designates measuring equipment which operates with the downstream flow. The downstream flow arrives at this equipment 40 via channel 41 which communicates with annular gap 420.

Channel 41 does not communicate with the upstream fluid that has passed through first measuring equipment 39 or upstream measuring equipment. The fluid from the upstream measuring equipment is only mixed with the fluid coming from the part downstream of the drain after this downstream fluid has passed through downstream measuring equipment 40.

Pump 42 discharges all the upstream and downstream fluid.

FIG. 4 shows a pump activated by an electric motor supplied by cable 43.

Measuring equipment 39 and 40 can be connected by electric wires, not shown, to an electronic box 44 which serves to process the various signals to transfer them to the surface via electrical cable 43 which may comprise one or more electrical links.

Comparison of the downhole measurements with the wellhead measurements converted into the downhole condition allows the measurements to be verified and validated by establishing balances (balances of each phase are preserved).

The presence of redundant measurements and simple conditions of flow continuity of each phase during movement of the device in the well may allow direct calibration of the measuring assembly. Another possibility consists of varying the total flow without moving the measuring assembly.

Figure 5:
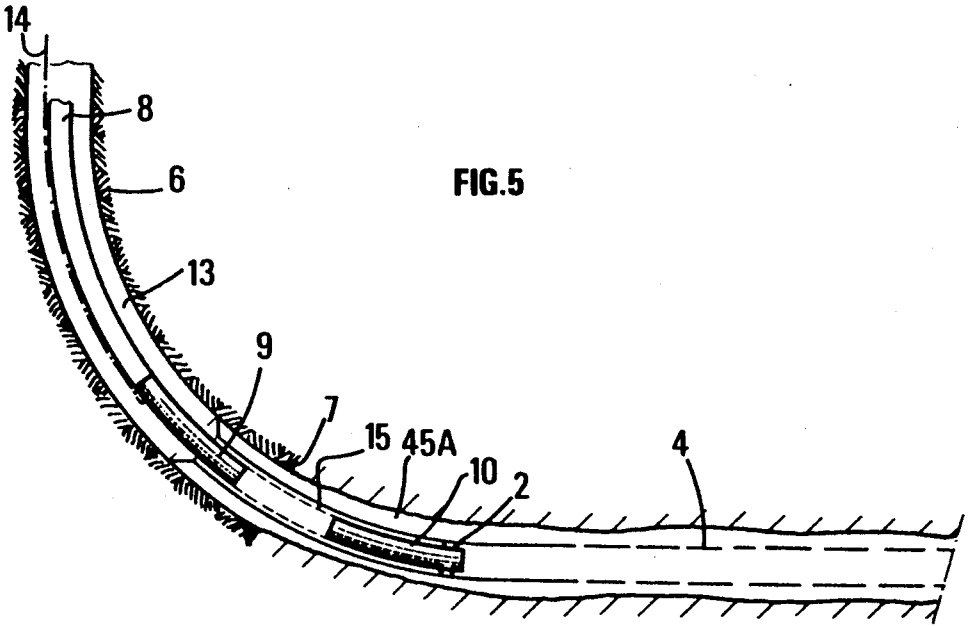
FIG. 5 represents the position of the tubing in a position allowing fitting or calibration of measuring elements.

Finally, there is a particularly interesting possibility from the standpoint of tool calibration when this assembly shown in FIG. 4 is positioned at the head of the perforated liner at a point where this liner is not yet perforated (see FIG. 5).

Indeed, in this case, the entire output of the well passes through the upstream measuring device, with washers 2 preventing the fluid from flowing along another circuit. Zone 45A, even if it is not cemented, forms a dead end for the fluid. Calibration can be easily accomplished by comparison with the wellhead measurements. Several measuring points can be obtained by causing the speed of the pump to vary. If necessary, the downstream measuring device can be calibrated by imposing at the wellhead a circulation through the annular gap of the tubing, which can be 24.5 cm ($9\frac{5}{8}''$) in diameter.

It may be noted that this device also has the advantages of: concentration of the flow, allowing for scattered flows and greater measuring accuracy; and elimination of any risk of backflow in the well (only the flows at the pump inlet are counted).

In the case of measuring inside a non-cemented perforated liner, an error may occur because of circulation behind the liner (part of the downstream flow counted by the upstream flowmeter or vice versa).

Thus, in the first phase, a qualitative indication of such a circulation behind the perforated liner might be obtained by having a differential pressure measurement between the inputs of the two upstream and downstream measuring devices.

This measurement in fact indicates the direction of the leak behind the liner but cannot give any indication as to the size of the fluid flowrate. However, it may be assumed that this leak rate is proportional to this pressure differential $Q_F=\alpha\Delta p$. It will thus be zero if the pressure losses in the two measuring devices are identical.

In FIG. 4, reference numerals 45 and 46 designate absolute, relative, or differential pressure sensors, which are connected to the electronic box by lines 47.

The use of a device allowing the pressure losses to be varied in one of the two measuring assemblies at least allows the error due to the leak rate to be minimized by setting the differential pressure to zero. Such a device can be adjusted by a command from electronic box 44 or can be automatic.

The characteristics of the leak behind the perforated liner can be evaluated as follows:

Positioning the assembly in the drain;

Speed of pump $Q_T$

Measurement of upstream and downstream flowrates and pressure after adjusting the device mentioned above to set the differential pressure to a zero value:

$$Q_T = Q_{do} + Q_{up}$$

Complete closure of downstream flowmeter. This assumes that the downstream measuring means 40 include a remote-controlled blocking means.

Adjustment of pump flowrate in order to obtain the same pressure in the upstream part of the drain. New flowrate $Q'_T = Q'_{up}$. Measurement of differential pressure $\Delta_p$.

The leak characteristic is then determined by $$\alpha' = \frac{(Q'_{up} - Q_{up})}{\Delta_p}$$

Also, by means of a throttle system in one of the two upstream or downstream circuits, one may attempt to bring about an artificial pressure loss measurement and determine the leak from the measurements, in particular, the pressures and flowrates upstream and downstream.

The presence of solid particles (sand) in the production flow may pose a problem for the measuring instruments and for the pump. Also, the determination of any sand-production zones of limited extent may be of interest to the degree that it allows for the use of a sand-control process over a limited sand length (possibility of using a chemical consolidation process, limited length of screen leading to lower cost and lower clogging risk).

Locating a screen downstream of the measuring tools would protect the measuring instruments.

Sand production detection could be achieved by an impact detector 48 (noise log) offered by most well-logging companies.

A sand trap 49 fitted between screen 50 and the impact detector allows the sand to be sampled and allows a semi-quantitative indication of the measurements obtained by the impact detector to be supplied, by comparing the quantity of sand to the total impact count recorded.

Figure 6:
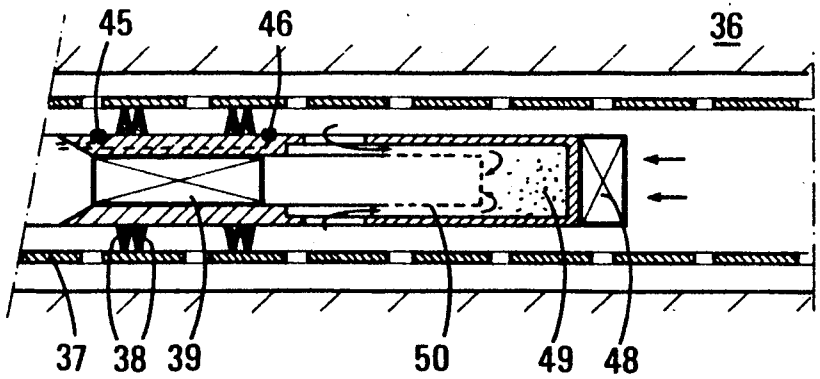
FIG. 6 shows a system for detecting sand inflows.

In FIG. 6, the sand trap is composed in particular of a sand circulation circuit with a baffle shape, upstream of screen 50.

Figure 7:
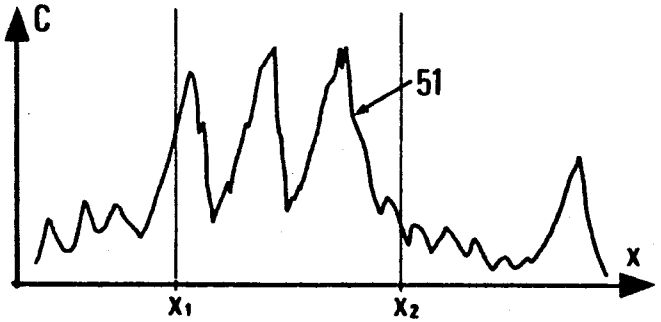
FIGS. 7 and 8 show curves relating to inflows of sand and water.
Figure 8:
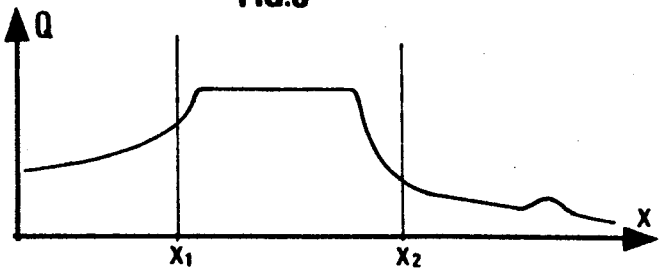

FIGS. 7 and 8 show one example of the conclusions that may be obtained from the device and process according to the invention.

In these FIGS. 7 and 8, abscissa x represents the curved abscissa along the production part of the drain. The ordinate of FIG. 7 shows counts c made by the impact detector. Curve 51 represents the number of impacts (as a function of curved abscissa x). Between x1 and x2, this number is high. The integral of this curve is essentially linked to the total quantity of sand drained and can thus be compared to the quantity of sand collected in sand trap 49.

FIG. 8, whose abscissa axis is based on that of FIG. 7, shows on the ordinate a magnitude Q proportional to the quantity of water collected. This value can for example be the water-cut ratio that corresponds to the quantity of water produced as a ratio of the total quantity of liquid produced (water+oil). More simply, this value can be equal to the flow of water produced.

In FIG. 8, this value Q indicates a sharp increase between x1 and x2, corresponding to the zone where there is substantial sand inflow.

Thus, with these results, the production operator can decide to stop production of the drain at the portion between x1 and x2 and thus increase the production quality of his well.

Thus far, two methods of transmission of information from the well bottom have been described, one being transmission by electrical cable and the other by mud wave.

It will not be a departure from the scope of the present invention to use transmission by electromagnetic waves as described in the article by P. de Gauque and R. Grudzinski entitled "Propagation of Electromagnetic Waves Along a Drillstring of Finite Conductivity" that appeared in SPE Drilling Engineering of June 1987. Likewise, it will not be a departure from the scope of the present invention to combine some of these various transmission means.

What is claimed is:

1. Process for making production well logs in a non-flowing well having a slanting or horizontal part the process comprising the steps of providing at least a first measuring means in the well, activating said well to trigger production of effluents on both sides of said first measuring means, and measuring at least one of a flow and composition mixture of at least one part of the effluents from a flow upstream relative to said first measuring means.

2. A process according to claim 1, further comprising the steps of providing a second measuring means in the well, and measuring at least one of a flow and composition mixture of at least one part of the effluents from a flow downstream relative to said first measuring means.

3. Process according to claim 1 wherein said first measuring means is adapted to measure substantially all of the upstream flow.

4. Process according to claim 1, further comprising the steps of providing a second measuring means in the well, and measuring substantially all flow downstream of said first measuring means.

5. Process according to claim 1, further comprising the step of monitoring a pressure differential existing in the production well between respective sides of said first measuring means.

6. Process according to claim 1, further comprising the step of calculating balances based on a comparison of downhole measurements with well head conditions converted into a downhole condition.

7. Process according to claim 1, further comprising the step of calibrating the first measuring means by eliminating a flow downstream thereof.

8. Process according to claim 1, wherein, further comprising the step of transmitting information from a bottom of the well by electromagnetic waves.

9. Device for making production well logs in a non-flowing well, the device comprising means for activating to production of the well, and first measuring means located upstream of said activation means for measuring at least one of a flow and composition mixture of effluent produced by activation of the well of at least a part of a flow upstream of said activation means.

10. Device according to claim 9, further comprising channel means between said activation means and said first measuring means.

11. Device according to claim 10, further comprising second measuring means for measuring at least one of a flow rate and mixture composition of at least a part of a flow of effluent downstream of said first measuring means, and wherein an inlet to said second measuring means is connected to said channel means.

12. Device according to one of claims 9, 10 or 11, further comprising means for separating the upstream flow from the flow downstream relative to said first measuring means.

13. Device according to claim 9, further comprising means for measuring one of pressures and pressure differentials between respective sides of said first measuring means.

14. Device according to claim 13, further comprising pressure measuring means for measuring said pressure differential and at least one of an upstream or downstream pressure prevailing on either side of said first measuring means.

15. Device according to claim 9, further comprising means for regulating a pressure differential between respective sides of said first measuring means.

16. Device according to claim 9, wherein said activation means comprises an electric motor.

17. Device according to claim 9, wherein said activation means comprises a hydraulic motor.

18. Device according to claim 9 wherein said activation means and said measuring means are attached to an end of a tubing arranged in the well.

19. Device according to claim 18, wherein said activation means comprises a hydraulic motor supplied by a secondary tubing located in said first-mentioned tubing.

20. Device according to claim 9, further comprising means for transmitting information from a bottom of the well by electromagnetic waves.

* * * * *